US011346111B1

(12) United States Patent
Purpus et al.

(10) Patent No.: US 11,346,111 B1
(45) Date of Patent: May 31, 2022

(54) DECORATIVE COLUMN ASSEMBLY

(71) Applicant: Superior Aluminum Products, Inc., Russia, OH (US)

(72) Inventors: Matthew F. Purpus, Minster, OH (US); Anton J. Luthman, Ft. Loramie, OH (US); Douglas E. Borchers, Russia, OH (US); Christopher A. Haynes, Granger, IN (US); Scott L. Sayer, Three Rivers, MI (US)

(73) Assignee: Superior Aluminum Products, Inc., Russia, OH (US)

( * ) Notice: Subject to any disclaimer, the term of this patent is extended or adjusted under 35 U.S.C. 154(b) by 0 days.

(21) Appl. No.: 17/321,016

(22) Filed: May 14, 2021

(51) Int. Cl.
*E04F 13/076* (2006.01)
*E04F 13/08* (2006.01)

(52) U.S. Cl.
CPC ..... *E04F 13/076* (2013.01); *E04F 13/0894* (2013.01)

(58) Field of Classification Search
CPC . E04F 13/0736; E04F 13/076; E04F 13/0894; E04F 13/0733; E04F 19/064; E04B 2/7453
See application file for complete search history.

(56) References Cited

U.S. PATENT DOCUMENTS 3,539,425 A * 11/1970 Marburg ..... A47B 88/9416 156/247
3,951,294 A * 4/1976 Wilson ..... C05F 17/907 220/4.31
4,019,301 A * 4/1977 Fox ..... E02D 5/60 52/834
4,888,933 A * 12/1989 Guomundsson ..... E04B 2/707 52/779
7,104,525 B2 * 9/2006 Ricci ..... E04H 12/2292 256/1
7,997,044 B2 * 8/2011 Green ..... E04C 3/36 52/834
9,175,703 B2 * 11/2015 Maertens ..... A47B 96/206
9,482,023 B1 * 11/2016 Carmody ..... E04H 12/2292
9,719,542 B2 * 8/2017 Cappelle ..... A47B 88/9412
10,081,963 B2 * 9/2018 Neighbor ..... E04H 12/08
10,450,759 B1 * 10/2019 Carmody ..... A47G 29/1216
2001/0022056 A1 * 9/2001 Gifford ..... E04F 13/0733 52/311.1
2005/0229531 A1 * 10/2005 Green ..... E04C 3/36 52/834
2006/0185270 A1 * 8/2006 Handley ..... E04F 11/1814 52/169.14
2010/0223882 A1 * 9/2010 Parenti ..... E04F 13/0733 52/834

(Continued)

*Primary Examiner* — Gisele D Ford
(74) *Attorney, Agent, or Firm* — Dorton & Willis, LLP

(57) ABSTRACT

A mechanically-interlocked decorative column assembly, and methods for forming such a column assembly without the use of adhesives. The column assembly includes at least first and second panel members that may be joined together form a column. Each panel member may be formed from extruded from cellular foam polyvinyl chloride (PVC) material. First and second interlocking structures provided on the first and second panel members, respectively, engage to maintain the panel members in the assembled condition during the service life of the column assembly, without the need for adhesives.

18 Claims, 4 Drawing Sheets

(56) References Cited

U.S. PATENT DOCUMENTS

| | | | | |
|---|---|---|---|---|
| 2010/0236182 | A1* | 9/2010 | Mackenzie | E04F 19/00 52/588.1 |
| 2010/0242377 | A1* | 9/2010 | Koteskey | E02D 29/124 52/20 |
| 2011/0185670 | A1* | 8/2011 | Mitchell | E04F 13/076 52/539 |

* cited by examiner

DECORATIVE COLUMN ASSEMBLY

TECHNICAL FIELD

The present invention relates generally to building materials and, more particularly, to a mechanically interlocked decorative column assembly.

BACKGROUND

In addition to serving as load-bearing supports, columns have been used to provide a pleasing appearance to buildings and other architectural structures. Moreover, some columns may be used solely for aesthetic appearance, and may provide no functional support. It is common practice to enclose structural support posts made from concrete, metal, or wood within an outer covering that provides improved aesthetic appearance. Conventional coverings for such structural support posts generally comprise multiple sections that are assembled together around the circumference of the support post, and may be made from various materials such as aluminum or fiberglass. More recently, decorative column assemblies have been made from cellular foam polyvinyl chloride (PVC) material. Cellular foam PVC exhibits a more foam-like consistency compared to "rigid PVC," and produces a desirable appearance and feel that is complementary to other building products used for trim and finishing purposes. Conventional methods for enclosing structural support posts with cellular foam PVC require adhesives (epoxies) to join the multiple sections that are assembled together around the circumference of the support posts. The use of such adhesives is time consuming, messy, and can be difficult to handle, particularly when being installed by an individual. Moreover, these previous assembly methods require additional supports or devices to clamp or otherwise hold the sections together while the adhesives cure. Accordingly, there is a need for improved decorative columns and assembly methods that overcome these and other drawbacks of conventional decorative columns.

SUMMARY

The present invention provides a mechanically-interlocked decorative column assembly, and methods for forming such a column assembly without the use of adhesives. In one aspect, an exemplary column assembly includes at least first and second panel members that may be joined together form a column, wherein each panel member is preferably formed from extruded from cellular foam polyvinyl chloride (PVC) material. First and second interlocking structures provided on the first and second panel members, respectively, engage to maintain the panel members in the assembled condition during the service life of the column assembly, without the need for adhesives. As used herein, a typical service life of a decorative column assembly may be as much as 30 years or more, for example. It will be appreciated that the service life of a decorative column assembly may vary depending on the service environment and the care and maintenance of the decorative column assembly.

In another aspect, the first interlock structure includes a first recess defined by first and second oppositely disposed sidewalls, and the second interlock structure includes a tongue configured to be received in the first recess when the panel members are assembled together. A first protrusion on the tongue is configured to be received within a first groove on the first sidewall, and first and second locking faces on the first groove and protrusion, respectively, are engaged in the assembled condition of the panel members to mechanically lock the panel members together.

In another aspect, a method of forming a decorative column includes mechanically joining a first panel member to a second panel member without adhesive. The first and second panel members are joined by engaging a first interlock structure on the first panel member with a second interlock structure on the second panel member. The first interlock structure includes a first recess defined by first and second oppositely disposed sidewalls, and the second interlock structure includes a tongue configured to be received in the first recess when the panel members are assembled together. A first protrusion on the tongue is configured to be received in a first groove located withing the recess in the assembled condition of the column.

The above and other objects and advantages of the present invention shall be made apparent form the accompanying drawings and the description thereof.

BRIEF DESCRIPTION OF THE DRAWINGS

The accompanying drawings, which are incorporated in and constitute a part of this specification, illustrate exemplary embodiments of the invention and, together with the general description of the invention given above, and the detailed description given below, serve to explain the principles of the present invention.

DETAILED DESCRIPTION

Figure 1:
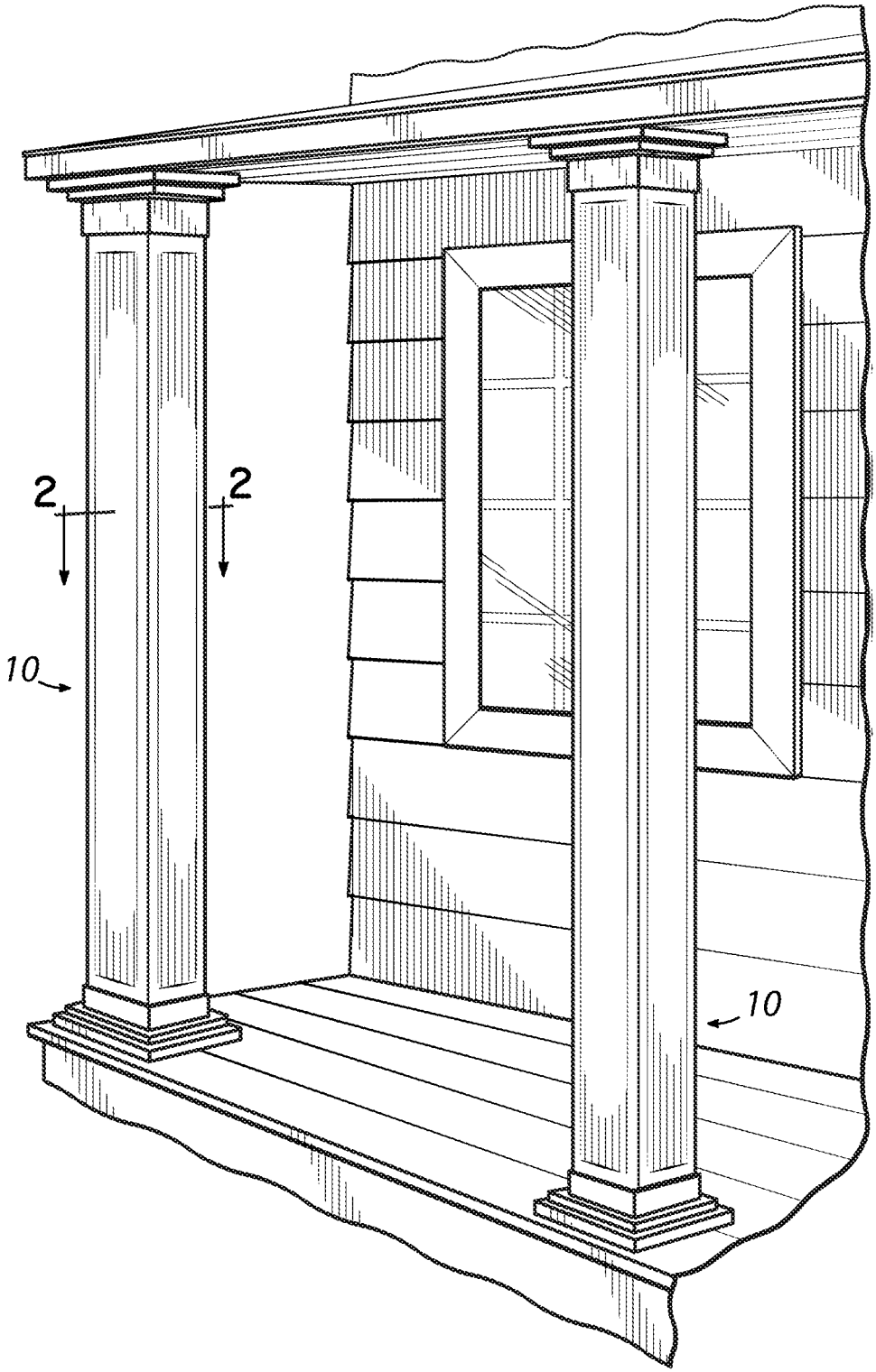
FIG. 1 depicts an architectural structure including an exemplary decorative column assembly in accordance with the principles of the present disclosure.
Figure 2:
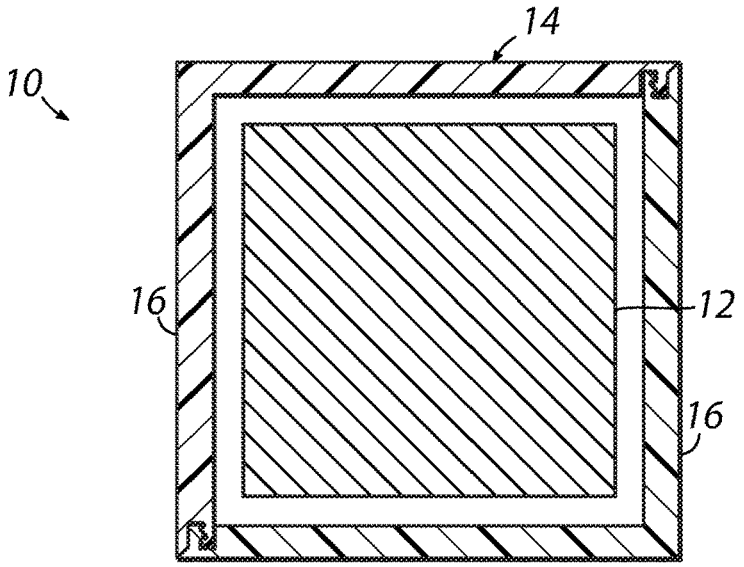
FIG. 2 is a cross-sectional view of the column assembly of FIG. 1, taken along line 2-2.

FIG. 1 depicts an architectural structure in the form of a porch roof that is supported by a plurality of columns 10 in accordance with the principles of the present disclosure. FIG. 2 depicts a cross-sectional view of a column 10 of FIG. 1, where it is seen that a structural support post 12 is enclosed by a decorative column assembly 14 in accordance with the principles of the present disclosure. As illustrated in FIG. 2, the decorative column assembly 14 includes a plurality of panel members 16 that are mechanically interlocked, without the use of adhesive, to provide an aesthetically pleasing appearance to the otherwise visually unappealing structural support post 12. In the embodiment shown, the panel members 16 are formed from extruded cellular foam polyvinyl chloride (PVC) material, and two angled, or L-shaped, panel members 16 enclose the generally square-shaped structural support post 12. While two angled panel members are shown and described herein, it will be appreciated that a decorative column assembly in accordance with the present disclosure may comprise more than two panel members, and may have various other shapes as may be desired. Moreover, while the columns 10 depicted in FIG. 1 have generally straight, untapered profiles, column assemblies in accordance with the present disclosure may alternatively be configured so that the resulting columns have a taper, wherein the circumference of a resulting column is greater near the base than near the top. Column assembles in accordance with the present disclosure may also be provided with flutes, raised panels, recessed panels, or various other decorative features that further enhance their aesthetic appearance.

Figure 3:
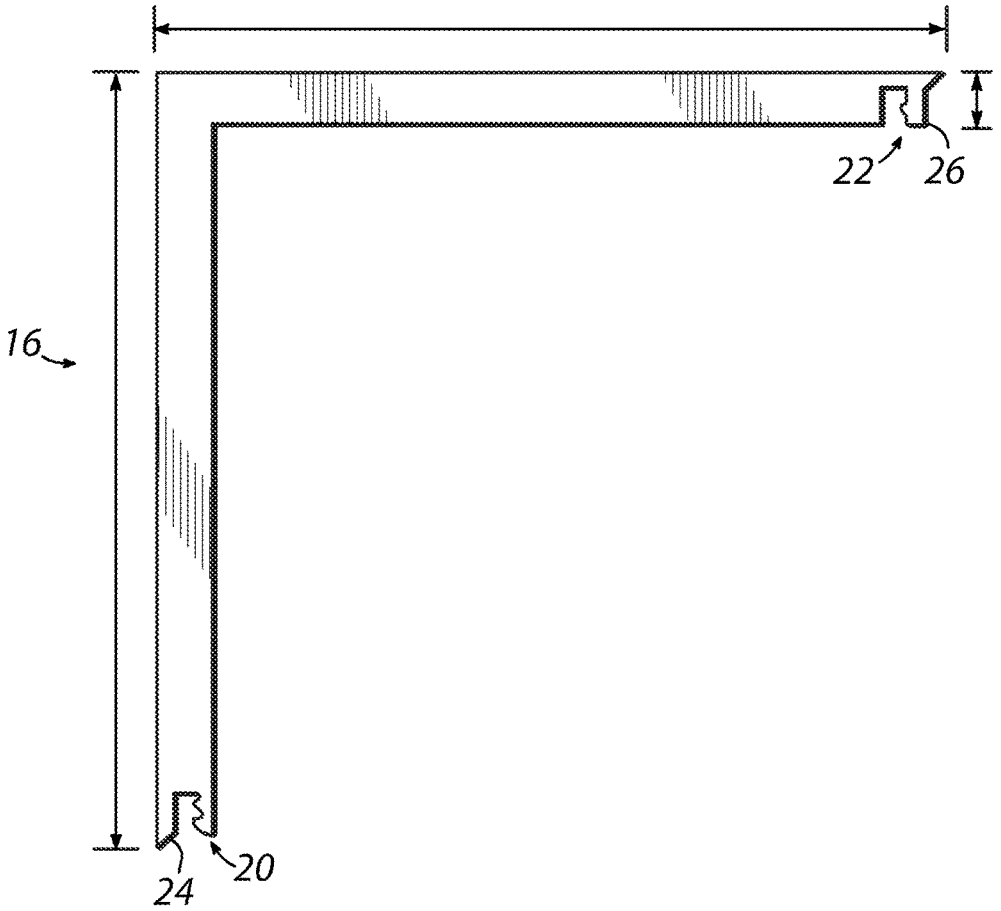
FIG. 3 is a cross-sectional view of an exemplary panel member of the column assembly of FIG. 1.
Figure 4:
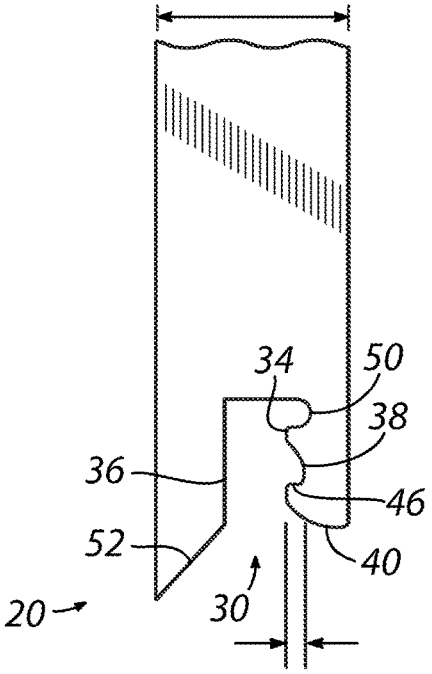
FIG. 4 is a detail view of a first interlock structure of the panel member of FIG. 3.
Figure 5:
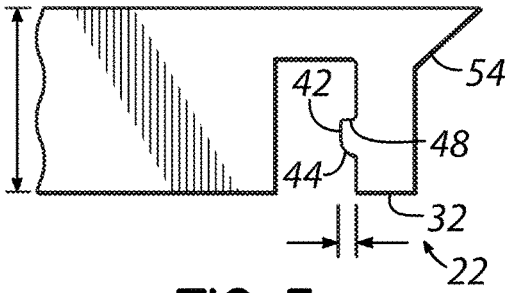
FIG. 5 is a detail view of a second interlock structure of the panel member of FIG. 3.

FIG. 3 depicts a cross-sectional view of an exemplary panel member 16 of the decorative column assembly 14 of FIG. 2. The exemplary panel member 16 includes first and second interlock structures 20, 22 provided on respective terminal ends 24, 26 for joining the panel member 16 to another panel member 16 of the decorative column assembly 14. With continued reference to FIG. 3, and referring further to FIGS. 4 and 5, details of exemplary first and second interlock structures 20, 22 will be described. In FIG. 4, the first interlock structure 20 includes a first recess 30 for receiving a corresponding tongue 32 provided on the second interlock structure 22, as depicted in FIG. 5. The first recess 30 is defined by first and second oppositely disposed sidewalls 34, 36 that are spaced apart a distance to securely receive the tongue 32 of the second interlock structure 22 therebetween. When the exemplary panel member 16 is assembled together with another panel member 16, the second sidewall 36 provides a counterpressure against the tongue 32 to help retain the tongue 32 in the first recess 30.

To firmly secure the panel members 16 of the decorative column assembly 14 together during the service life of the column assembly 14, the first and second interlock structures 20, 22 further include features that cooperate to mechanically interlock the panel members 16 without the need for adhesive. As shown in FIG. 4, the first interlock structure 20 further includes a first groove 38 in the first sidewall 34 and positioned adjacent a leading edge 40 of the first sidewall 34. The first groove 38 opens toward the second sidewall 36 and is configured to cooperate with features of the second interlock structure 22. Accordingly, the second interlock structure 22 further includes a first protrusion 42 on the tongue 32, which is positioned and arranged to be received within the first groove 38 of the first interlock structure 20 in an assembled condition of the decorative column assembly 14. The first groove 38 and the first protrusion 42 have complementary geometries that interengage in the assembled condition to provide a tight snap-fit and prevent withdrawal of the tongue 32 from the first recess 30.

To facilitate the insertion of the tongue 32 within the first recess 30, and to position the first protrusion 42 in the first groove 38, the leading edge 40 of the first sidewall 34 and a leading edge 44 of the first protrusion 42 may have arcuate, or rounded, shapes that facilitate initial sliding of these features over one another. The first and second interlock structures 20, 22 further include respective first and second locking faces 46, 48 adapted to engage one another in surface contact such that the assembled first and second locking structures 20, 22 are not separable, even when exposed to severe service conditions, such as high wind loads or inadvertent impacts. In the embodiment shown, the first and second locking faces 46, 48 are generally planar and are generally aligned perpendicular to the first sidewall 34 and the tongue 32, respectively, such that when the tongue 32 is inserted within the first recess 30, the first protrusion 42 snaps into the first groove 38, and the first and second locking faces 46, 48 engage one another in surface contact, whereby withdrawal of the tongue 32 from the first recess 30 is prohibited.

In another aspect, the dimensions and configuration of the first and second interlock structures 20, 22 are selected to facilitate relatively easy assembly of the panel members 16 to one another, while ensuring a robust mechanical interlock without the need for adhesives. In one embodiment, the first groove 38 may have a depth of at least approximately 0.033 inch (0.838 mm), and the first protrusion 42 on the second interlock structure 22 may have a height of at least approximately 0.031 inch (0.787 mm). The first interlock structure 20 may further include a second groove 50 in the first sidewall 34 to facilitate assembly of the first and second interlock structures 20, 22. In the embodiment shown, the second groove 50 is spaced from the first groove 38 in a direction opposite the leading edge 40 of the first sidewall 34 and has a shape that is configured to reduce stress in the first sidewall 34 during the assembly of first and second interlock structure 20, 22, whereby the first sidewall 34 may deflect outwardly away from the second sidewall 36 during insertion of the tongue 32 within the first recess 30, and then spring back to its non-deflected configuration in the assembled condition.

Figure 4A:
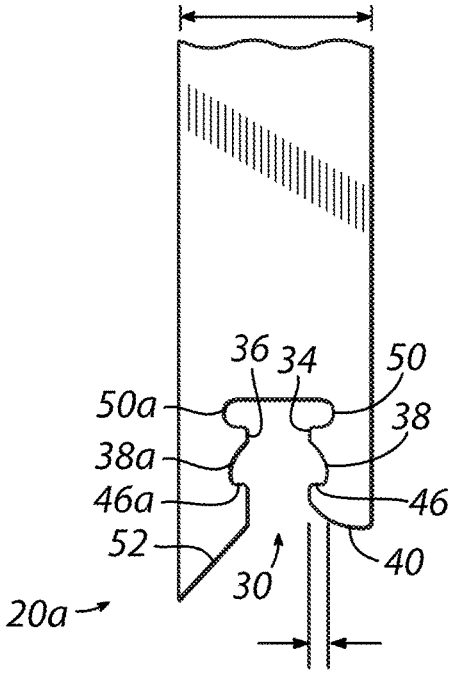
FIG. 4A is a detail view of another embodiment of first interlock structure, similar to the interlock structure of FIG. 4.
Figure 5A:
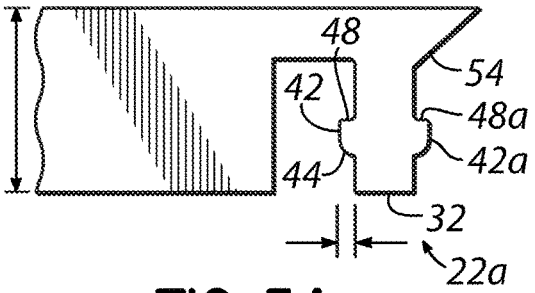
FIG. 5A is a detail view of another embodiment of second interlock structure, similar to the interlock structure of FIG. 5.

With continued reference to FIGS. 2-5, the first and second interlock structures 20, 22 may further include respective first and second bevel faces 52, 54 at the respective distal ends 24, 26 of the panel member 16. The bevel faces 52, 54 are complementary in shape so that they mate with one another to form a corner joint in the assembled condition of the decorative column assembly 14. While the embodiments of FIGS. 4 and 5 are shown and described as having a generally flat second sidewall 36 on the first interlock structure 20, and a generally flat mating surface on the tongue 32 of the second interlock structure 22, it will be appreciated that these features may have other configurations in other embodiments. As non-limiting examples, FIGS. 4A and 5A illustrate alternative embodiments of a first locking structure 20*a* having additional first and second grooves 38*a*, 50*a* on the second sidewall 36, and an additional first locking face 46*a*, for cooperating with an additional first protrusion 42*a* and additional second locking face 48*a* provided on a second locking structure 22*a*. Other features of these alternative embodiments of the first and second locking structure 20*a*, 22*a* which are similar to the features depicted in FIGS. 4 and 5 are similarly numbered.

Figure 6:
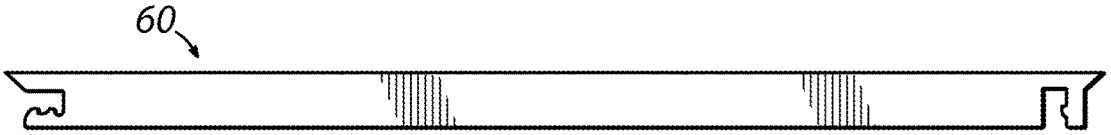
FIG. 6 is a cross-sectional view of a second exemplary panel member in accordance with the principles of the present disclosure.
Figure 7:
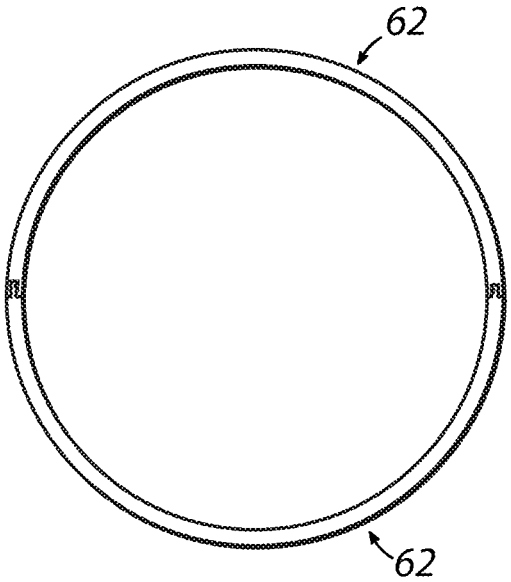
FIG. 7 is a schematic illustration depicting a second exemplary column assembly in cross-section.
Figure 8:
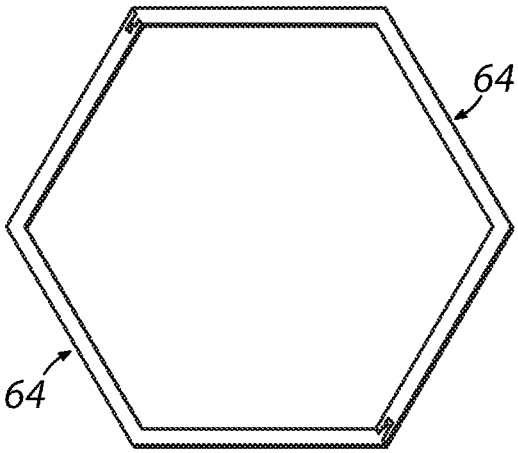
FIG. 8 is a schematic illustration depicting a third exemplary column assembly in cross-section.

While the exemplary panel member 16 shown and described with respect to FIGS. 2 and 3 has an angled shape, it will be appreciated that panel members in accordance with the present disclosure may have various other shapes. As non-limiting examples of alternative panel members, FIG. 6 depicts an exemplary panel member having a generally flat cross-sectional shape, FIG. 7 depicts exemplary panel members 62 that are joined together to form a column assembly having a generally circular cross-sectional shape, and FIG. 8 depicts exemplary panel members 64 that are joined together to form a column assembly having a generally hexagonal cross-sectional shape. Moreover, while panel member 16 is shown and described herein as having both first and second interlock structure 20, 22, it will be appreciated that various other configurations of panel members in accordance with the principles of the present disclosure may alternatively be provided with the same interlock structure on each distal end, wherein both distal ends comprise first interlock structure 20, or both distal ends comprise second interlock structure 22. In such embodiments, forming a decorative column assembly would involve joining a panel member having two of the first interlock structure 20 with a different panel member having two of the second interlock structure 22.

In use, a decorative column assembly 14 may be assembled around a structural support post 12, or may even be used without a support post 12, to provide an aesthetically pleasing appearance to a building or other architectural structure. To form the decorative column assembly 14, at least a first panel member 16 as described herein is mechanically joined to a second panel member 16, without adhesive, by engaging a first interlock structure 20 on the first panel member 16 with a second interlock structure 22 on the second panel member 16. As the first interlock structure 20 and second interlock structure 22 are brought into engagement, a tongue 32 on the second interlock structure 22 is received within the first recess 30 of the first interlock structure 20, and a first protrusion 42 on the tongue 32 is received in the first groove 38 of the first interlock structure 20 such that the first protrusion 42 snaps into the first groove 38 and first and second locking faces 46, 48 engage one another in surface contact so that the tongue 32 cannot be withdrawn from the first recess 30 during the service life of the column assembly 14. In the assembled condition, the second sidewall 36 of the first interlock structure 20 applies counterpressure against the tongue 32 of the second interlock structure to 22 maintain a firm engagement of the first protrusion 42 in the first groove 38. The exemplary interlock structure 20, 22 of the exemplary decorative column assembly 14 disclosed herein facilitates ready assembly of the decorative column without the need for adhesives or additional devices to clamp the panel members 16 together.

While the present invention has been illustrated by a description of various embodiments, and while these embodiments have been described in considerable detail, it is not intended to restrict or in any way limit the scope of the appended claims to such detail. The various features shown and described herein may be used alone or in any combination. Additional advantages and modifications will readily appear to those skilled in the art. The invention in its broader aspects is therefore not limited to the specific details, representative apparatus and method, and illustrative example shown and described. Accordingly, departures may be made from such details without departing from the spirit and scope of the general inventive concept.

What is claimed is:

1. A mechanically interlocked decorative column assembly, comprising:

at least first and second panel members joinable in a non-planar arrangement to form a closed section column, each panel member extruded from cellular foam polyvinyl chloride (PVC) material and having interlock structure on each terminal end as viewed in cross-section;

at least a first interlock structure on the first panel member;

at least a second interlock structure on the second panel member;

the first interlock structure comprising:

a first recess defined by first and second oppositely disposed sidewalls, a first groove in the first sidewall adjacent a terminal end of the first sidewall and opening toward the second sidewall, the first groove configured to receive features of the second interlock structure, a first locking face within the first groove; and the second interlock structure comprising:

a tongue configured to be received in the first recess of the first interlock structure, at least a first protrusion on the tongue and configured to be received in the first groove in the assembled condition of the column assembly, a second locking face on the first protrusion and configured to engage the first locking face in the assembled condition of the column assembly such that the first and second panel members are mechanically locked together without adhesive during the service life of the column assembly; wherein the first recess has an insertion direction for receiving the tongue and that is aligned parallel to the plane of the first panel member; and wherein the tongue has an insertion direction for inserting the tongue into the first recess and that is aligned perpendicular to the plane of the second panel member.

2. The column assembly of claim 1, wherein the first interlock structure further comprises a second groove in the first sidewall, spaced from the first groove opposite the terminal end of the first sidewall, the second groove having a shape configured to reduce stress in the first sidewall during assembly of the first and second panels to one another.

3. The column assembly of claim 2, wherein the second groove has a smooth curvate shape.

4. The column assembly of claim 1, wherein the second sidewall is configured to provide counterpressure against the second interlock structure in an assembled condition of the column assembly.

5. The column assembly of claim 1, wherein the second sidewall comprises a substantially flat surface facing the first sidewall.

6. The column assembly of claim 1, wherein the second sidewall comprises an additional first groove opening toward the first sidewall.

7. The column assembly of claim 6, wherein the second interlock structure further comprises an additional first protrusion on the tongue and configured to be received in the additional first groove in the second sidewall in the assembled condition of the column assembly.

8. The column assembly of claim 1, further comprising:

a first bevel face on the terminal end of the first interlock structure; and a second bevel face on the terminal end of the second interlock structure, the second bevel face complementary to the first bevel face such that the first and second bevel faces cooperate to form a corner joint in an assembled condition of the column assembly.

9. A panel member for a decorative column assembly, the panel member comprising:

a panel body extruded from cellular foam polyvinyl chloride (PVC) material and having interlock structure on each terminal end as viewed in cross-section;

the interlock structure comprising at least one of a first interlock structure or a second interlock structure on the panel body;

the first interlock structure comprising:

a first recess defined by first and second oppositely disposed sidewalls, a first groove in the first sidewall adjacent a terminal end of the first sidewall and opening toward the second sidewall, the first groove configured to cooperate/receive features of the second interlock structure, and a first locking face within the first groove; and the second interlock structure comprising:

a tongue configured to be received in the first recess of the first interlock structure, at least a first protrusion on the tongue and configured to be received in the first groove in the assembled condition of the column assembly, and a second locking face on the first protrusion and configured to engage the first locking face in the assembled condition of a column assembly having at least two complementary panel members joined in a non-planar arrangement such that the two panel members are mechanically locked together without adhesive; wherein the first recess has an insertion direction for receiving the tongue and that is aligned parallel to the plane of the panel body; and wherein the tongue has an insertion direction for inserting the tongue into the first recess and that is aligned perpendicular to the plane of the panel body.

10. The panel member of claim 9, wherein the first interlock structure further comprises a second groove in the first sidewall, spaced from the first groove opposite the terminal end of the first sidewall, the second groove having a shape configured to reduce stress in the first sidewall during assembly of at least two complementary panel members to one another.

11. The panel member of claim 10, wherein the second groove has a smooth curvate shape.

12. The panel member of claim 9, wherein the second sidewall is configured to provide counterpressure against the second interlock structure in an assembled condition of the column assembly.

13. The panel member of claim 9, wherein the second sidewall comprises a substantially flat surface facing the first sidewall.

14. The panel member of claim 9, wherein the panel member comprises one first interlock structure and one second interlock structure, whereby two such panel members are configured to be mechanically joined together, without adhesive, by operably engaging the first interlock structure on one of the panel members with the second interlock structure on the other of the panel members.

15. The panel member of claim 9, having two of either the first interlock structure or the second interlock structure, whereby the panel member can be mechanically joined with a panel member having two of the other of the first interlock structure or the second interlock structure, without adhesive, by operably engaging the first interlock structures on one of the panel members with the second interlock structures on the other of the panel members.

16. A method of forming a decorative column, the method comprising:

mechanically joining a first panel member to a second panel member in a non-planar arrangement and without adhesive, for the service life of the column;

wherein joining the first panel member to the second panel member comprises engaging a first interlock structure on the first panel member with a second interlock structure on the second panel member;

wherein the first interlock structure comprises:

a first recess defined by first and second oppositely disposed sidewalls, a first groove in the first sidewall adjacent a terminal end of the first sidewall and opening toward the second sidewall, the first groove configured to cooperate/receive features of the second interlock structure; and wherein the second interlock structure comprises:

a tongue configured to be received in the first recess of the first interlock structure, at least a first protrusion on the tongue and configured to be received in the first groove in the assembled condition of the column; wherein the first recess has an insertion direction for receiving the tongue and that is aligned parallel to the plane of the first panel member; and wherein the tongue has an insertion direction for inserting the tongue into the first recess and that is aligned perpendicular to the plane of the second panel member.

17. The method of claim 16, further comprising:

applying counter pressure against the second interlock structure with the second sidewall of the first interlock structure in the assembled condition of the column assembly.

18. The method of claim 16, wherein:

the first interlocking structure further comprises a first locking face within the first groove;

the second interlocking structure further comprises a second locking face on the first protrusion; and engaging the first interlock structure with the second interlock structure further comprises engaging the first locking face with the second locking face such that the first and second panel members are mechanically locked together without adhesive.

* * * * *